US005669579A

United States Patent [19]

Zacharias

[11] Patent Number: 5,669,579

[45] Date of Patent: Sep. 23, 1997

[54] METHOD FOR DETERMINING THE LINE-OF-SIGHT RATES OF TURN WITH A RIGID SEEKER HEAD

[75] Inventor: Athanassios Zacharias, Bayerisch Gmain, Germany

[73] Assignee: Mafo Systemtechnik Dr.-Ing. A. Zacharias, GmbH & Co. KG, Teisendorf, Germany

[21] Appl. No.: 570,382

[22] Filed: Dec. 11, 1995

Related U.S. Application Data

[63] Continuation of Ser. No. 340,148, Nov. 15, 1994, abandoned.

[30] Foreign Application Priority Data

Nov. 16, 1993 [DE] Germany ..... 43 39 187.7

[51] Int. Cl.[6] ..... F41G 7/20

[52] U.S. Cl. ..... 244/3.15

[58] Field of Search ..... 244/3.15

[56] References Cited

U.S. PATENT DOCUMENTS

| | | | |
|---|---|---|---|
| 4,108,400 | 8/1978 | Groutage et al. | 244/3.15 |
| 4,492,352 | 1/1985 | Yueh | 244/3.15 |
| 4,502,650 | 3/1985 | Yueh | 244/3.15 |
| 4,542,870 | 9/1985 | Howell | 244/3.15 |
| 4,643,373 | 2/1987 | Adams | 244/3.15 |
| 4,750,688 | 6/1988 | Davies | 244/3.15 |
| 4,830,311 | 5/1989 | Pritchard et al. | 244/3.15 |
| 5,052,637 | 10/1991 | Lipps | 244/3.15 |
| 5,253,823 | 10/1993 | Lawrence | 244/3.15 |
| 5,279,478 | 1/1994 | Baida et al. | 244/3.15 |
| 5,440,314 | 8/1995 | Tabourier | 342/371 |

FOREIGN PATENT DOCUMENTS

| | | | |
|---|---|---|---|
| 32 33 612 | 3/1984 | Germany . | |
| 3442598A1 | 6/1989 | Germany . | |
| 4034419A1 | 5/1991 | Germany . | |
| 4007999C2 | 8/1992 | Germany . | |
| 4238521C1 | 10/1993 | Germany . | |
| 5644909 | 4/1981 | Japan | 244/3.15 |
| 2150698 | 6/1990 | Japan | 244/3.15 |
| 3247997 | 11/1991 | Japan | 244/3.15 |
| 565 988 | 8/1975 | Switzerland . | |
| 106 066 | 7/1988 | United Kingdom . | |

OTHER PUBLICATIONS

The Infrared Handbook, revised edition, 1985 pp. 22–63 to 22–87.

Guidance and Control Aspects of Tactical Air–Launched Missiles, May, 1980, pp. 11–1 to 11–15.

*Primary Examiner*—Michael J. Carone
*Assistant Examiner*—Christopher K. Montgomery
*Attorney, Agent, or Firm*—Flynn, Thiel, Boutell & Tanis, P.C.

[57] ABSTRACT

A method for determining the rates of turn of the missile/target line of sight with a seeker head rigidly mounted on the missile, characterized in that the azimuth and elevation deviation angles ($\psi_{sm}$ and $\Theta_{sm}$) of the target measured with the rigidly mounted seeker head (2) in the missile-fixed coordinate system ($s_1$, $S_2$, $s_3$) are transformed to the azimuth and elevation deviation angles ($\psi_v$ and $\Theta_v$) of the target based on the coordinate system ($v_1$, $v_2$, $v_3$) of a virtual, gimbal mounted and gyrostabilized seeker head (2v) that tracks the missile/target line of sight (SL) by rotation with the rates of turn ($p_v$, $q_v$, $r_v$) about its three axes ($v_1$, $v_2$, $v_3$).

19 Claims, 5 Drawing Sheets

METHOD FOR DETERMINING THE LINE-OF-SIGHT RATES OF TURN WITH A RIGID SEEKER HEAD

This application is a continuation of application Ser. No. 08/340,148, filed Nov. 13, 1994, now abandoned.

FIELD OF THE INVENTION

The present invention relates to a method for determining the rates of turn of the missile/target line of sight with a seeker head rigidly mounted on the missile.

BACKGROUND OF THE INVENTION

A method is known (according to German Patent Document No. DE 34 42 598 A1), wherein an inertially stabilized missile seeker head is suspended on gimbals in the missile and measures the components of the rates of turn of the missile/target line of sight. The measured values are used as input values for controlling the missile by the law of guidance of proportional navigation.

Gimbal suspension of seeker heads requires elaborate high-precision mechanics. A seeker head rigidly mounted on the missile would have considerable advantages due to its simplicity. However it has the disadvantage that the deviation angle detected therewith leads to an output signal dependent not only on the rate of turn of the missile/target line of sight but also on the rate of turn of the missile.

German Patent Document No. DE 42 38 521 C2 discloses a device for detecting targets on the ground by sensors of various spectral ranges for low-flying airplanes, whereby a sensor is mounted on a lift-producing missile towed by the airplane and the sensor signals are decoupled from the missile's own motions without the use of gyroscopes by constant measurement of its attitude angles relative to the airplane.

German Patent Document Nos. DE 40 34 419 A1 and DE 40 07 999 C2 disclose missiles with a gimbal suspended, inertially stabilized television camera whose signals are directed to a monitor to guide the missile from there.

SUMMARY OF THE INVENTION

The invention is based on the problem of providing a method permitting proportional navigation to be performed in simple fashion using a seeker head rigidly mounted on the missile.

According to the invention the output signals from the seeker head rigidly mounted on the missile are used to make a gimbal suspended and gyrostabilized virtual seeker head track the line of sight.

In the inventive method the virtual seeker head represents the mathematical model of a gimbal mounted and gyrostabilized seeker head in the computer. The virtual seeker head's follow-up simulation taking place at the same time as the motion of the missile permits determination of the rate of turn of the missile/target line of sight.

The frame assembly and the gyrostabilization of the virtual seeker head, i.e. whether it is stabilized e.g. by a rotating mass or external rate gyros, play no essential part for the inventive method. The nature of the frame design and gyrostabilization are reflected in the software of the virtual seeker head.

Leaving aside details such as necessary coordinate transformations and diverse conversions, the rate of turn of the line of sight is determined according to the invention as follows.

Azimuth and elevation deviation angles of the target, measured in the rigid seeker head, are converted to the azimuth and elevation deviation angles of the virtual seeker head.

The virtual seeker head rotates its associated line of sight with a first-order (or higher) time response.

The motions of the virtual seeker head calculated by the software yield the rates of turn of the virtual seeker head in the inertial system or, with earth-fixed application, in the geodetic system which enter the guidance algorithm. From the rates of turn of the virtual seeker head one also determines the particular attitude angles of the virtual seeker head, i.e. its angular position in the inertial system. This is required for converting the attitude angles from the rigid to the virtual seeker head.

The missile follows the guidance commands, changing its position and attitude, which in turn changes the deviation angles in the rigid seeker head. These angles are converted to the virtual seeker head again. This closes the loop.

BRIEF DESCRIPTION OF THE DRAWINGS

In the following the invention will be explained in more detail with reference to the drawing, in which.

DETAILED DESCRIPTION

Figure 1:
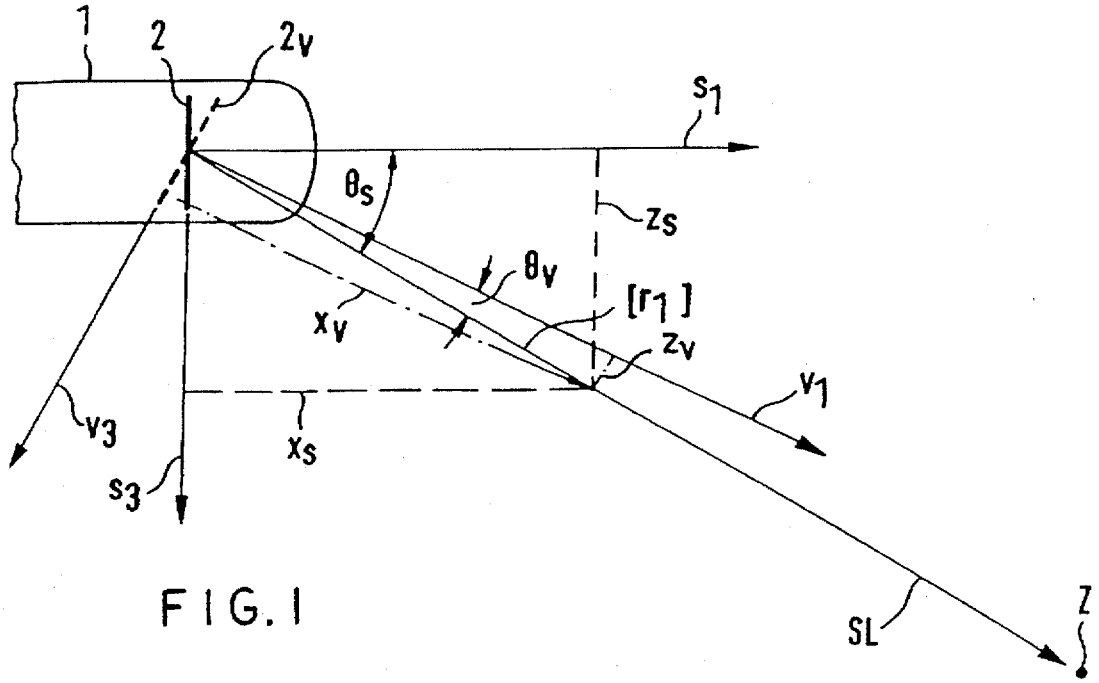
FIG. 1 shows a schematic plane representation of the elevation deviation angle for the rigid and virtual seeker heads.

According to FIG. 1 missile 1 has seeker head 2 rigidly disposed therein. The symbol $s_1$ designates the missile's longitudinal axis, which is at the same time the axis of rigid seeker head 2, and SL designates the line of sight from missile 1 to target Z.

Angle $\Theta_s$ represents the elevation deviation angle of rigid seeker head 2, i.e. the angle between the missile's longitudinal axis $s_1$ or the axis of rigid seeker head 2 and line of sight SL.

Line 2v designates the virtual seeker head, $v_1$ its axis, and $\Theta_v$ the deviation angle between axis $v_1$ of virtual seeker head 2v and line of sight SL.

Deviation angle $\Theta_s$ yields the line-of-sight unit vector $[r_1]$ components $x_s$ and $z_s$ in the system of the rigid seeker head, as follows:

$$\begin{bmatrix} x_s \\ z_s \end{bmatrix} = \begin{bmatrix} \cos\Theta_s \\ \sin\Theta_s \end{bmatrix} \tag{1}$$

The components of unit vector $[r_1]$ in the rigid system, i.e. $x_s$ and $z_s$, are converted to the components of the virtual system, $x_v$ and $z_v$, by the following equation:

$$\begin{bmatrix} x_v \\ z_v \end{bmatrix} = [T]_{vs} \times \begin{bmatrix} x_s \\ z_s \end{bmatrix} \quad (2)$$

where $[T]_{vs}$ represents the transformation matrix for conversion from the rigid to the virtual system.

The required virtual deviation angle $\Theta_v$ is according to FIG. 1

$$\Theta_v = \arctan \frac{z_v}{x_v} \quad (3)$$

Rate of turn $q_v$ of virtual seeker head 2v is, assuming first-order tracking behavior, $$q_v = K \cdot \Theta_v \quad (4)$$

First-order tracking behavior is only by way of example and can be replaced by a higher-order tracking behavior.

Figure 2:
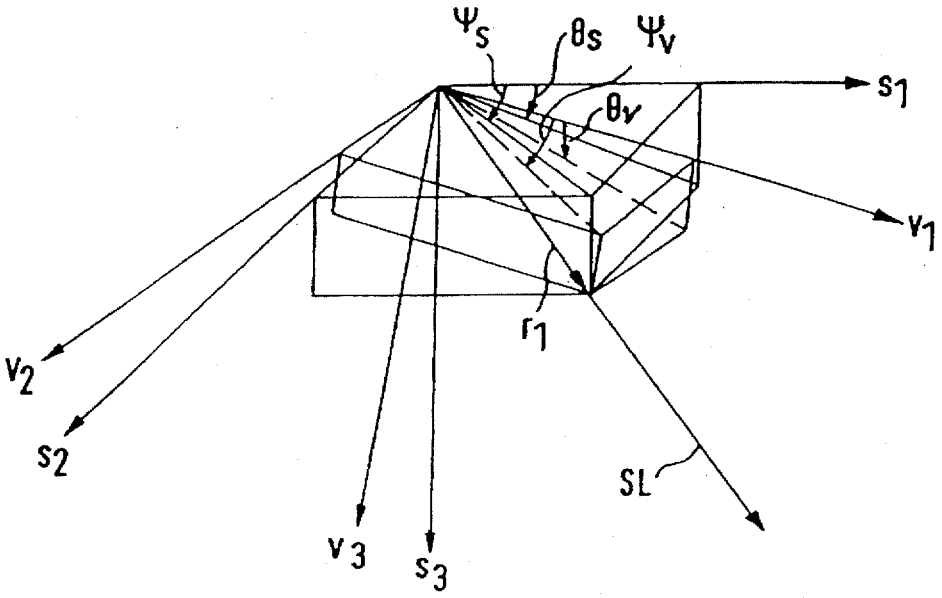
FIG. 2 shows a three-dimensional representation corresponding to FIG. 1, omitting the missile and the rigid and virtual seeker heads.

FIG. 2 shows the three-dimensional coordinate system of the rigid and virtual seeker heads with the particular deviation angles $\Theta_s$ and $\Theta_v$ (elevation) and $\psi_s$ and $\psi_v$ (azimuth).

Figure 3:
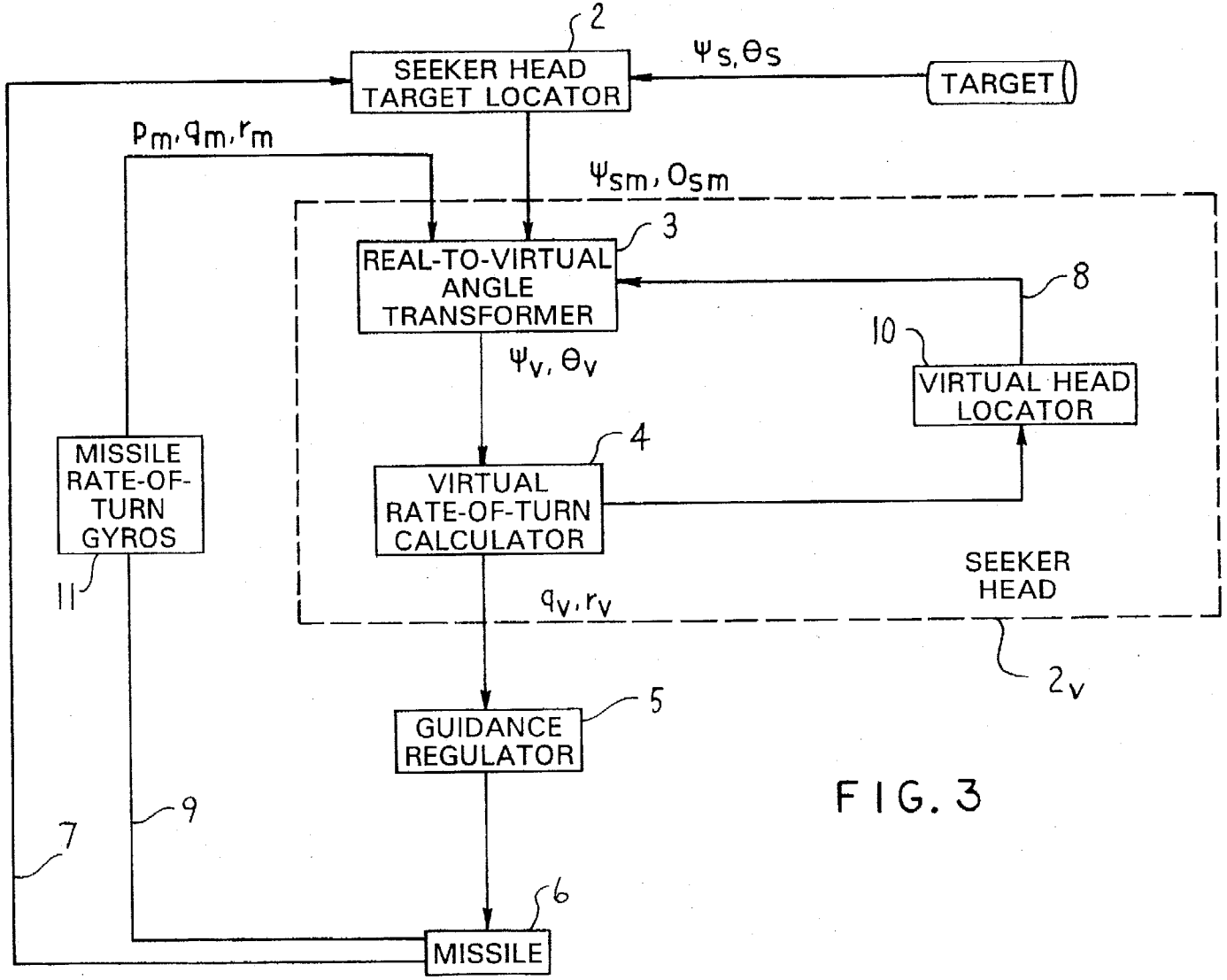
FIG. 3 is a block diagram of the main components of a missile and guidance system configured to execute the guidance method of this invention.

According to the functional block diagram of FIG. 3 rigid seeker head 2 receives actual azimuth and elevation deviation angles $\psi_s$ and $\Theta_s$ as input quantities. Deviation angles $\psi_s$ and $\Theta_s$ are measured with a measuring unit and measured deviation angles $\psi_{sm}$ and $\Theta_{sm}$ transformed in virtual seeker head 2v by transformation software 3 to azimuth and elevation deviation angles $\psi_v$ and $\Theta_v$ of virtual seeker head 2v.

Virtual deviation angles $\psi_v$ and $\Theta_v$ are fed to dynamic mathematical model 4 of virtual seeker head 2 and rates of turn $q_v$, $r_v$ of virtual seeker head 2v are calculated from them, being used to make virtual seeker head 2v track line of sight SL.

The values of rates of turn $q_v$ and $r_v$ enter at the same time into guidance regulator 5 to form the commands for missile 6, so that the missile velocity vector is rotated proportionally to line of sight SL. The loop is closed via feedback 7.

Transformation from rigid seeker head 2 to virtual seeker head 2v with transformation matrix $[T]_{vs}$ takes place by the following equation:

$$[T]_{vs} = [T]_{vI} \times [T]_{IS} \quad (5)$$

where $[T]_{vI}$ designates the transformation matrix from the inertial (geodetic) system to the virtual system, and $[T]_{IS}$ the transformation matrix from the missile-fixed or rigid system to the inertial (geodetic) system, whereby:

$$[T]_{IS} = [T]_{SI}^{T} \quad (6)$$

where $[T]_{SI}^{T}$ is the transposed transformation matrix from the inertial (geodetic) system to the missile-fixed system.

Conversion with transformation software 3 from the rigid to the virtual system using equations (5) and (6) takes place via loops 8 and 9. For this purpose rates of turn $p_v$, $q_v$ and $r_v$ of virtual seeker head 2v are determined via loop 8 by software 10 and used to form transformation matrix $[T]_{vI}$. Via loop 9 rates of turn p, q and r of rigid seeker head 2 are measured, being used to form transformation matrix $[T]_{IS}$.

Rates of turn p, q, r of rigid seeker head 2 can be obtained with rate gyros 11, for example three uniaxial rate gyros or one uniaxial and one biaxial rate gyro.

Figure 4:
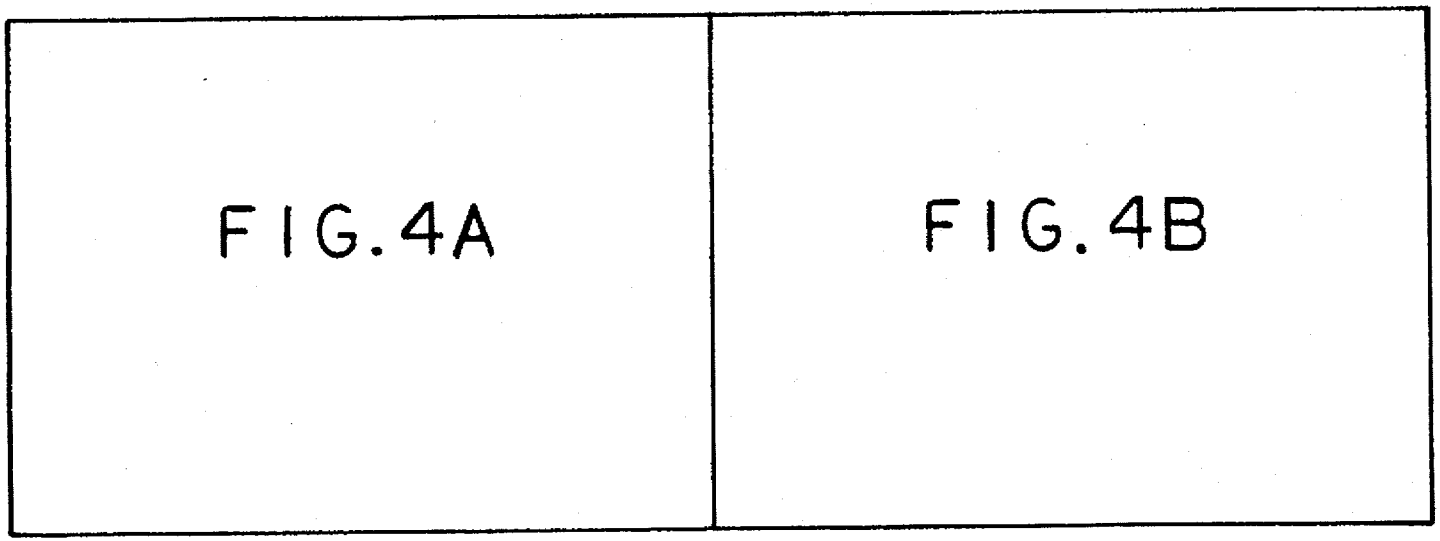
FIG. 4 is an assembly diagram depicting how
Figure 4A:
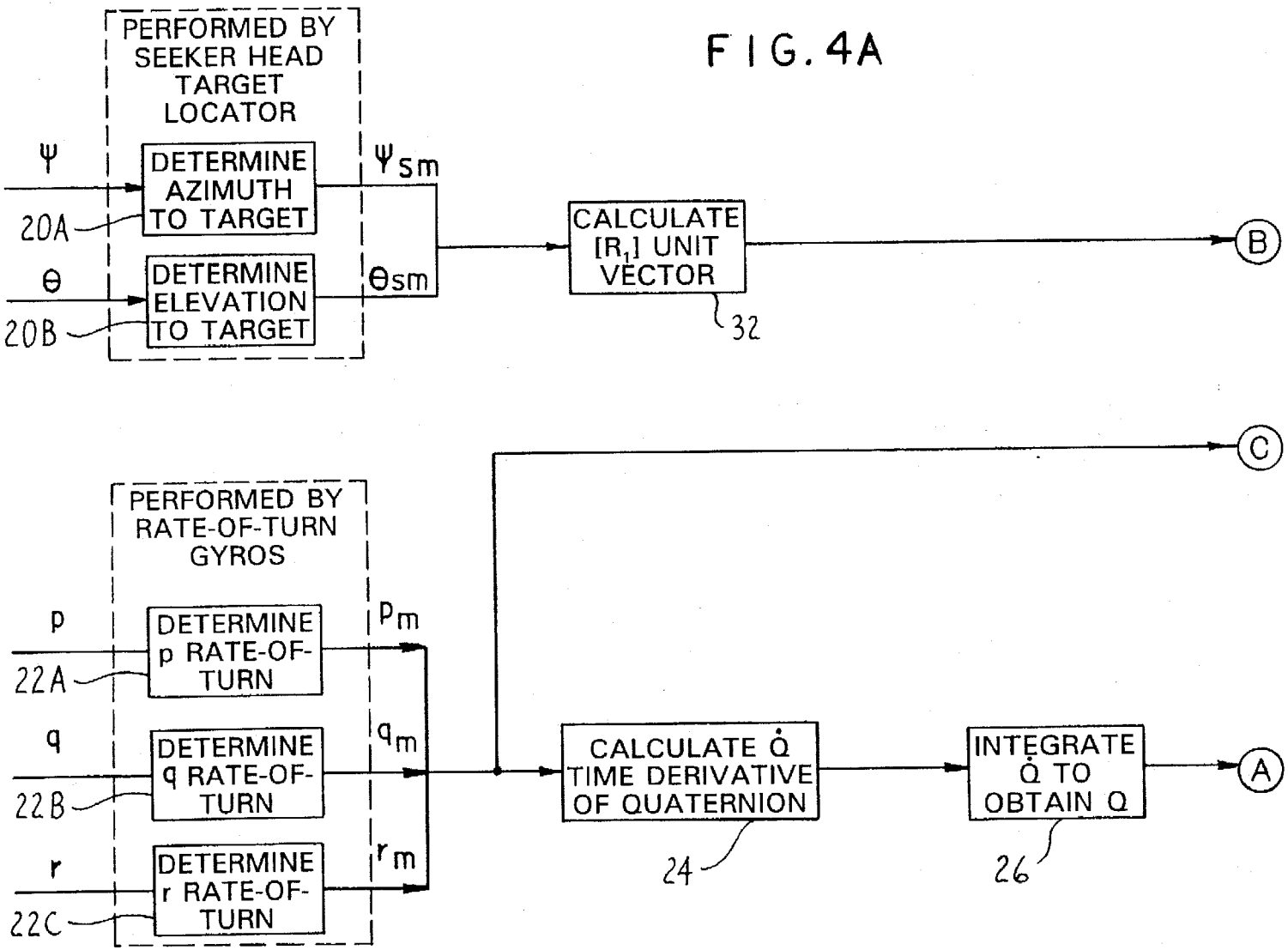
FIGS. 4A and 4B are assembled to form a flow chart of the steps performed during execution of the guidance method of this invention.
Figure 4B:
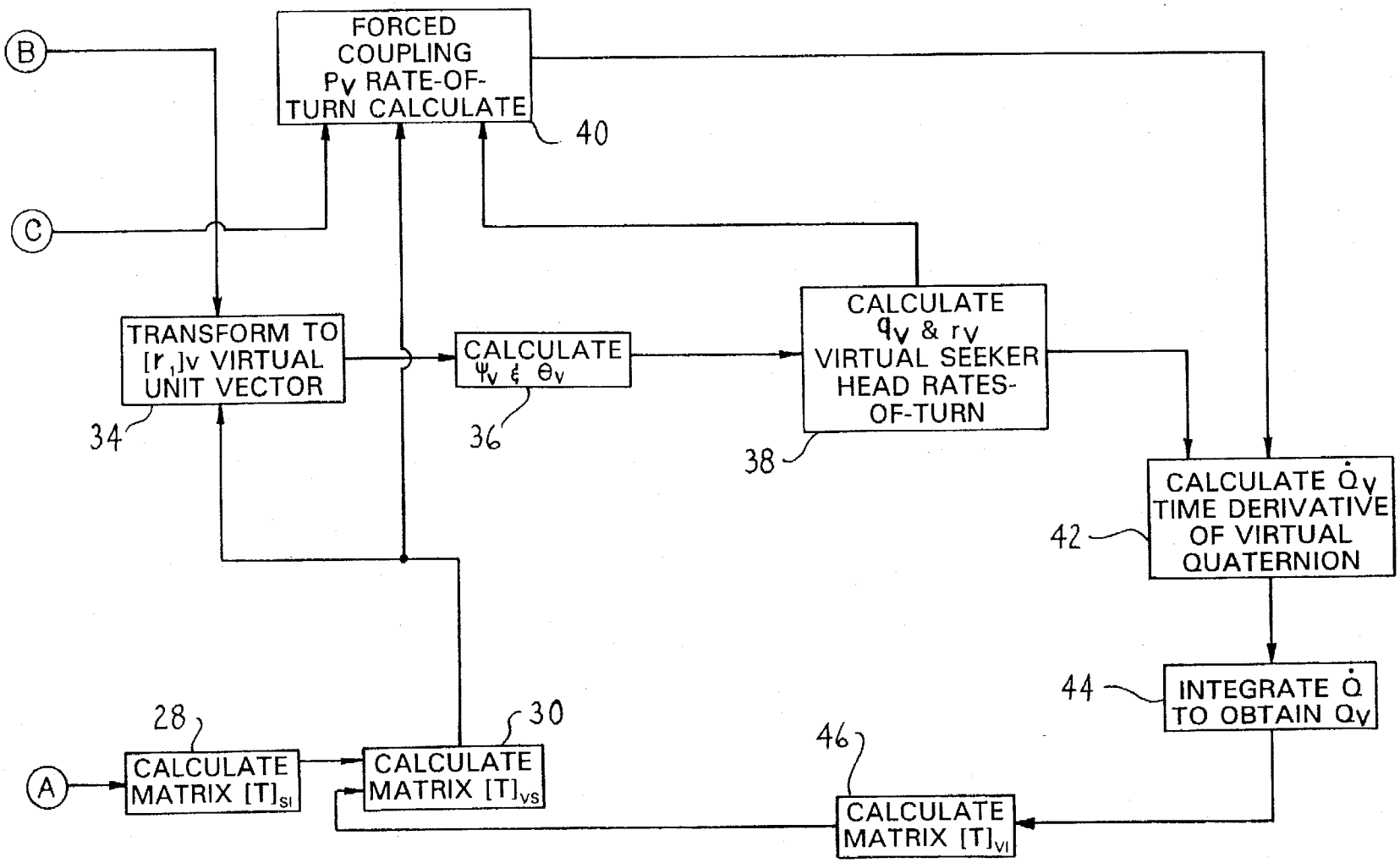

FIGS. 4A and 4B illustrate the process steps executed for realizing virtual seeker head 2v.

Seeker head 2 rigidly mounted on missile 1 accordingly has deviation angles $\psi_s$ and $\Theta_s$, while rate gyros 11 measure rates of turn $p_m$, $q_m$, $r_m$.

One thus obtains the following input quantities for virtual seeker head 2v:

a) deviation angles $\psi_{sm}$ and $\Theta_{sm}$ which seeker head 2 rigidly mounted on missile 1 outputs as measured values, and b) values represented by steps 20A and 20B, respectively, $p_m$, $q_m$, $r_m$ are measured by rate gyros 11 as represented by steps 22A, 22B and 22C, respectively, for the rates of turn of missile 1, based on the three axes of the body-fixed (rigid) coordinate system.

From rates of turn $p_m$, $q_m$, $r_m$ one forms time derivative Q of quaternion Q, step 24. By integration, step 26, one obtains quaternion Q and thus transformation matrix $[T]_{SI}$, step 28, for transformation from the inertial (geodetic) to the missile-fixed (rigid) system.

With the aid of transformation matrix $[T]_{vI}$ for transformation from the inertial system to the virtual seeker head system, and transformation matrix $[T]_{IS}$ for transformation from the rigid to the inertial geodetic system, one obtains by the above equation (5) transformation matrix $[T]_{vs}$ for transformation from the body-fixed (rigid) seeker head system to the virtual seeker head system, step 30.

From measured deviation angles $\psi_{sm}$, $\theta_{sm}$ of rigid seeker head 2 one forms the components of unit vector $[r_1]$ in target direction Z in the missile-fixed (rigid) system, as explained above in connection with FIG. 1 and components $x_s$, $z_s$, step 32. These components are converted with transformation matrix $[T]_{vs}$ to the virtual seeker head system (compare equation (2)) in step 34.

With transformed components $(x_v, z_v)$ of unit vector $[r_1]_v$ one determines deviation angles $\psi_v$ and $\Theta_v$ in virtual seeker head 2v in step 36.

Assuming a first-order tracking behavior, the required rates of turn of virtual seeker head 2v are proportional to the deviation angles (equations 4 and 7), represented by step 38.

$$q_v = K \cdot \Theta_v \quad \text{(4), and}$$

$$r_v = K \cdot \psi_v \quad (7)$$

Rates of turn $q_v$ and $r_v$ of virtual seeker head 2v are completed by rate of turn $p_v$ which is determined separately in step 40 via a forced coupling (ZK) since virtual seeker head 2v cannot rotate freely about its longitudinal axis.

From $p_v$, $q_v$, $r_v$ one obtains time derivative $Q_v$, step 42, and by integration, in step 44, quaternion Q from which transformation matrix $[T]_{vI}$ is formed, step 46, and which is used together with transformation matrix $[T]_{IS}$ to determine transformation matrix $[T]_{vs}$ according to equation (5).

In the inventive method azimuth and elevation deviation angles $\psi_{sm}$ and $\Theta_{sm}$ measured with the rigidly mounted seeker head are thus transformed to azimuth and elevation deviation angles $\psi_v$ and $\Theta_v$ of gimbal mounted and gyro-stabilized virtual seeker head 2v, which tracks line of sight SL by rotation $p_v$, $q_v$ and $r_v$ about its axes $v_1$, $v_2$, $v_3$.

The transformation of azimuth and elevation deviation angles $\psi_{sm}$ and $\theta_{sm}$ measured with rigidly mounted seeker head 2 to azimuth and elevation deviation angles $\psi_v$ and $\Theta_v$ of virtual seeker head 2v takes place, on the one hand, on the basis of rates of turn $p_v$, $q_v$, $r_v$ of virtual seeker head 2v about its axes $v_1$, $v_2$, $v_3$ which result from continuously determined azimuth and elevation deviation angles $\psi_v$, $\Theta_v$ of virtual seeker head 2v and forced coupling ZK and, on the other hand, on the basis of rates of turn $p_m$, $q_m$, $r_m$ of rigidly mounted seeker head 2 about body-fixed axes $s_1$, $s_2$, $s_3$.

Forced coupling ZK refers here to a mathematical condition which takes into consideration that virtual seeker head 2v is not freely rotatable in its longitudinal axis with respect to missile 1. Instead, rate of turn $p_v$ about axis $v_1$ of the virtual coordinate system results from:

rates of turn $q_v$ about axis $v_2$ and $r_v$ about axis $v_3$ of the virtual coordinate system rates of turn $p_m$, $q_m$, $r_m$ of the missile about missile-fixed axes $s_1$, $s_2$ and $s_3$, and transformation matrix $[T]_{vs}$ whereby transformation matrix $[T]_{vs}$ results from equations (5) and (6) above.

What is claimed is:

1. A method of determining a desired rate-of-turn of a guided missile toward a target for use by a guidance unit configured to steer the missile, the missile having a fixed seeker head rigidly attached thereto, the seeker head having a center point through which an on-target, line-of-sight axis extends, said method including the steps of:

measuring a real deviation angle between the seeker head and the target, said real deviation angle representing a deviation between the seeker head line-of-sight axis and the target relative to the seeker head center point;

determining a virtual seeker transformation matrix between the seeker head and a virtual seeker, said virtual seeker being centered on the seeker head center point and being selectively rotatable about the seeker head center point, said virtual seeker having a virtual line-of-sight that extends through the seeker head center point at a fixed angle relative to the virtual seeker, said determining step including the steps of:

measuring rotation of the seeker head line-of-sight axis in a reference coordinate system;

determining rotation of said virtual seeker virtual line-of-sight from the seeker head center point in the reference coordinate system, said rotation determination being performed by monitoring a calculated virtual seeker rate-of-turn; and basing said virtual seeker transformation matrix on said real seeker head measured rotation and said virtual seeker calculated rotation;

calculating a virtual deviation angle between said virtual seeker head and the target, said virtual deviation angle representing a deviation between said virtual seeker virtual line-of-sight and the target relative to the seeker head center point, said calculation being based on said real deviation angle and said virtual seeker transformation matrix; and calculating a virtual seeker rate-of-turn based on said calculated virtual deviation angle wherein said virtual seeker rate-of-turn is used in a subsequent virtual seeker virtual line-of-sight rotation determination step and is forwarded to the missile guidance unit as the missile rate-of-turn.

2. The method of determining missile rate-of-turn of claim 1, wherein:

said real deviation angle measurement step includes measuring a first, real azimuth deviation angle between the seeker head line-of-sight axis and the target relative to the seeker head center point and a second, real elevational deviation angle between the seeker head line-of-sight axis and the target relative to the seeker head center point; and said virtual deviation angle calculation step includes calculating a virtual azimuth deviation angle and a virtual elevational deviation angle based on said real azimuth deviation angle, said real elevational deviation angle and said virtual seeker transformation matrix; and said virtual seeker rate-of-turn is calculated based on said virtual azimuth deviation angle and said virtual elevational deviation angle.

3. The method of determining missile rate-of-turn of claim 2, wherein said seeker head line-of-sight rotation measurement step includes the step of measuring rotational displacement of the seeker head in a three-dimensional coordinate system.

4. The method of determining missile rate-of-turn of claim 2, wherein said virtual seeker rotates about the seeker head center point in the reference coordinate system, the reference coordinate system is a three dimensional coordinate system and in said virtual seeker rate-of-turn calculating step, rates-of-turn of said virtual seeker head in the three dimensions are calculated based on said virtual azimuth deviation angle and said virtual elevational deviation angle.

5. The method of determining missile rate-of-turn of claim 4, wherein said seeker head line-of-sight rotation measurement step includes the step of measuring rotational displacement of the seeker head in the three-dimensional coordinate system.

6. The method of determining missile rate-of-turn of claim 1, wherein said step of calculating said virtual seeker rate-of-turn includes calculating said rate-of-turn based on a first-order relationship with said virtual deviation angle.

7. The method of determining missile rate-of-turn of claim 1, wherein said step of calculating said virtual seeker rate-of-turn includes calculating said rate-of-turn based on a second-order or greater order relationship with said virtual deviation angle.

8. The method of determining missile rate-of-turn of claim 3, wherein said step of calculating said virtual seeker rate-of-turn includes calculating said rate-of-turn based on a first-order relationship with said virtual deviation angles.

9. The method of determining missile rate-of-turn of claim 3, wherein said step of calculating said virtual seeker rate-of-turn includes calculating said rate-of-turn based on a second-order or greater order relationship with said virtual deviation angles.

10. The method of determining missile rate-of-turn of claim 1, wherein said seeker head line-of-sight rotation measurement step is performed by measuring the rate of turn of the guided missile and by integrating said measured missile rate-of-turn.

11. The method of determining missile rate-of turn of claim 3, wherein said seeker head line-of-sight rotation measurement step is performed by measuring the rate of turn of the guided missile and by integrating said measured missile rate-of-turn.

12. A method of generating guidance commands for a guided missile, the missile having a rigid seeker head fixedly attached thereto that monitors the position of a target relative to the missile, said rigid seeker head having a center point through which a line-of-sight axis extends and a guidance system for directing the missile toward the target, said method including the steps of:

measuring a real deviation angle between the seeker head line-of-sight axis and the target relative to the seeker head center point;

determining a virtual seeker head transformation matrix between the seeker head and a virtual seeker, said virtual seeker head being rotatably centered on the seeker head center point, said virtual seeker having a virtual line-of-sight that extends from the seeker head center point at a fixed angle relative to said virtual seeker, said transformation matrix determination step including the step of determining the rotation of said virtual seeker around the seeker head center point based on a calculated virtual seeker rate-of-turn;

calculating a virtual deviation angle between said virtual seeker virtual line-of-sight and the target relative to the seeker head center point based on said real deviation angle and said virtual seeker transformation matrix;

calculating a virtual seeker rate-of-turn for said virtual seeker based on said virtual deviation angle;

supplying said virtual seeker rate-of-turn for use in a subsequent virtual seeker transformation matrix determination step; and generating commands to the missile guidance system based on said virtual seeker rate-of-turn.

13. The method of generating missile guidance commands of claim 12, wherein said step of calculating said virtual seeker rate-of-turn includes calculating said rate-of-turn based on a first-order relationship with said virtual deviation angle.

14. The method of generating missile guidance commands of claim 12, wherein said step of calculating said virtual seeker rate-of-turn includes calculating said rate-of-turn based on a second-order or greater order relationship with said virtual deviation angle.

15. The method of generating missile guidance commands of claim 12, wherein the missile moves in a three-dimensional reference coordinate system, and said real deviation angle measurement step includes measuring a first, real azimuth deviation angle between the seeker head line-of-sight axis and the target relative to the seeker head center point and a second, real elevational deviation angle between the seeker head line-of-sight axis and the target relative to the seeker head center point;

said virtual deviation angle calculation step includes calculating a virtual azimuth deviation angle and a virtual elevational deviation angle based on said real azimuth deviation angle, said real elevational deviation angle and said transformation matrix;

said virtual seeker rate-of-turn calculation step includes calculating a virtual-seeker rate-of-turn in each of the three coordinate system dimensions based on said virtual azimuth deviation angle and said virtual elevational deviation angle; and said missile guidance system command generation step includes generating commands to orient the missile in each of the three coordinate system dimensions based on said three virtual seeker rates-of-turn.

16. The method of generating guidance commands of claim 12, wherein said virtual seeker head transformation matrix determination step includes the steps of:

measuring rotation of the seeker head line of sight axis from a reference coordinate system; and calculating said virtual seeker transformation matrix from said seeker head measured rotation and said virtual seeker calculated rotation.

17. The method of generating missile guidance commands of claim 16, wherein the missile moves in a three-dimensional reference coordinate system, and said real deviation angle measurement step includes measuring a first, real azimuth deviation angle between the seeker head line-of-sight axis and the target relative to the seeker head center point and a second, real elevational deviation angle between the seeker head on-target line-of-sight axis and the target relative to the seeker head center point;

said virtual deviation angle calculation step includes calculating a virtual azimuth virtual deviation angle and a virtual elevational deviation angle based on said real azimuth deviation angle, said real elevational deviation angle and said transformation matrix;

said virtual seeker rate-of-turn calculation step includes calculating a virtual-seeker rate-of-turn in each of the three coordinate system dimensions based on said virtual azimuth deviation angle and said virtual elevational deviation angle; and said missile guidance system command generation step includes generating commands to orient the missile in each of the three coordinate system dimensions based on said three virtual seeker rates-of-turn.

18. The method of generating missile guidance commands of claim 17, wherein said step of calculating said virtual seeker rate-of-turn includes calculating the three individual rates-of-turn based on a first-order relationship with said virtual deviation angles.

19. The method of generating missile guidance commands of claim 17, wherein said step of calculating said virtual seeker rate-of-turn includes calculating the three individual rates-of-turn based on a second-order or greater order relationship with said virtual deviation angles.

* * * * *